US005923224A

United States Patent [19]

Makino et al.

[11] Patent Number: 5,923,224

[45] Date of Patent: Jul. 13, 1999

[54] NONRECIPROCAL CIRCUIT DEVICE

[75] Inventors: Toshihiro Makino, Mattou; Takashi Kawanami, Ishikawa-ken, both of Japan

[73] Assignee: Murata Manufacturing Co., Ltd., Japan

[21] Appl. No.: 08/924,147

[22] Filed: Sep. 5, 1997

[30] Foreign Application Priority Data

Sep. 6, 1996 [JP] Japan ..... 8-236648
Sep. 19, 1996 [JP] Japan ..... 8-248029

[51] Int. Cl.[6] ..... H01P 1/383

[52] U.S. Cl. ..... 333/1.1; 333/24.2

[58] Field of Search ..... 333/1.1, 24.2

[56] References Cited

U.S. PATENT DOCUMENTS 3,836,874 9/1974 Maeda et al. ..... 333/1.1

FOREIGN PATENT DOCUMENTS 2671912 7/1992 France ..... 333/1.1
56-24815 3/1981 Japan ..... 333/1.1
61-39703 2/1986 Japan ..... 333/24.2

*Primary Examiner*—Paul Gensler
*Attorney, Agent, or Firm*—Ostrolenk, Faber, Gerb & Soffen, LLP

[57] ABSTRACT

One or two inductor electrodes formed of hairpin-bent or curved electrode patterns are made on one main surface of a component member of a nonreciprocal circuit device, and connection electrodes are formed on the other main surface at positions corresponding to both ends of each inductor electrode. The component member may be a spacer member or a terminal board. Both ends of each inductor electrode are connected to the connection electrodes by through holes. The port sections of central conductors at the signal input and output side are connected to input and output terminal electrodes through the inductor electrodes, formed on the component member of the nonreciprocal circuit device. Each inductor electrode forms a low-pass filter in combination with capacitances in the nonreciprocal circuit device.

11 Claims, 14 Drawing Sheets

NONRECIPROCAL CIRCUIT DEVICE

BACKGROUND OF THE INVENTION

1. Field of the Invention

The present invention relates to nonreciprocal circuit devices for use in high-frequency bands including the microwave band, such as isolators and circulators, and more particularly, to nonreciprocal circuit devices which allow mobile communication units to be made compact and inexpensive when used in them.

2. Description of the Related Art

Nonreciprocal circuit devices such as lumped-constant isolators and circulators have characteristics in which attenuation is very low in the direction in which a signal is transferred and it is very high in the reverse direction. FIG. 9 shows a configuration of such an isolator.

This isolator includes a magnetic closed circuit formed mainly of an upper yoke 2 and a lower yoke 8; a permanent magnet 3; a spacer member 4; a magnetic assembly 5 formed of three central conductors 51, 52, and 53 and a ferrite 54; and a resin case 7. The port sections P1 and P2 of central conductors 51 and 52 are connected to input and output terminals 71 and 72 provided on the resin case 7 and matching capacitors Co. The port section P3 of central conductor 53 is connected to a matching capacitor Co and a terminating resistor R. An end of each capacitor Co and an end of the terminating resistor R are connected to ground terminals 73.

The spacer member 4 is disposed between the permanent magnet 3 and the magnetic assembly 5. When the upper yoke 2 fits in the lower yoke 8, the spacer member 4 presses and secures the magnetic assembly 5 and the resin case 7 to the lower yoke 8, and the matching capacitors Co and the terminating resistor R to the resin case 7. In addition, the spacer member 4 presses and secures the port sections P1 to P3 of the central conductors 51 to 53 to the matching capacitors Co, the terminating resistor R, and the input and output terminals 71 and 72, all of which are disposed in the resin case 7. In other words, the spacer member 4 fills an internal gap of the nonreciprocal circuit device and is used for stable holding and fixing of the components disposed inside the nonreciprocal circuit device, such as the magnetic assembly 5, the matching capacitors Co, and the terminating resistor R.

FIG. 10 is an equivalent circuit diagram of the isolator. As shown in FIG. 10, in the conventional isolator, the ports P1, P2, and P3, the tips of the central conductors 51, 52, and 53, are connected to the matching capacitors Co serving as matching circuits, and port P3 is connected to the terminating resistor R. Each inductance L corresponds to an equivalent inductance formed by the ferrite 54 and one of the central conductors 51, 52, and 53.

FIG. 22 shows a second conventional isolator. This isolator includes a magnetic closed circuit formed mainly of an upper yoke 2 and a lower yoke 8; a permanent magnet 3; a magnetic assembly 5 in which three central conductors 51, 52, and 53 overlappingly intersect each other on a ferrite 54; and a resin case 7. On the lower surface of the lower yoke is a terminal board 9 on which input and output electrodes 91 and 92 and a ground electrode 93 are formed. The port sections P1 and P2 of central conductors 51 and 52 are connected to input and output connection terminals 71 and 72 provided on the resin case 7 and matching capacitors Co. The port section P3 of a central conductor 53 is connected to a matching capacitor Co and a terminating resistor R. An end of each capacitor Co and an end of the terminating resistor R are connected to ground terminals 73. The input and output connection terminals 71 and 72, and the ground terminals 73 are connected to the input and output electrodes 91 and 92, and the ground electrode 93, respectively.

The terminal board 9 increases the degree of freedom in designing the signal input and output sections of the isolator by changing the shapes and positions of the signal input and output sections, as required, and assures stable and positive connection to a mounting board on which the isolator is to be mounted. The input and output electrodes 91 and 92, and the ground electrode 93 are formed as respective pairs of electrodes formed on corresponding main surfaces of the terminal board 9. Each pair of electrodes formed on both main surfaces are connected to each other by a through hole or an end-face electrode.

FIG. 23 is an equivalent circuit diagram of the isolator. As shown in FIG. 23, in the conventional isolator, the ports P1, P2, and P3, i.e. the tips of the central conductors 51, 52, and 53, are connected to the matching capacitors Co serving as matching circuits, and port P3 is connected to the terminating resistor R. Each inductance L corresponds to an equivalent inductance formed by the ferrite 54 and the central conductors 51, 52, and 53.

This isolator for use in a transmission and receiving circuit section of an antenna sharing circuit in a mobile communication unit such as a portable telephone or an automobile phone. The isolator is surface-mounted to a mounting board of which input and output transmission lines and a ground electrode are formed on the front surface and a ground electrode is formed on almost all areas of the rear surface.

An amplifier built into such a communication unit is nonlinear in general, and it causes extraneous emissions, that is, spurious signals, such as signals having frequencies which are multiples of that of the fundamental wave, especially the second harmonic and the third harmonic. Since these extraneous emissions may cause radio interference and malfunctions in the power amplification sections of other communication units, it is required to suppress the emissions to a certain level according to a standard.

An isolator also functions as a band-pass filter due to its transmission-direction characteristics. Therefore, attenuation is large even in the transmission direction in frequency bands away from the pass band. Since the main purpose of an isolator is not to obtain attenuation outside its frequency band, however, the desired attenuation cannot be obtained at the frequencies (especially those of the second harmonic and the third harmonic) of extraneous emission in the conventional isolator. Therefore, an additional filter is employed in the conventional communication unit to attenuate extraneous emissions.

In other words, when the conventional isolator is used, a filter for attenuating extraneous emissions is required as described above. The cost of components used increases by that of the filter, and the communication unit becomes large in size. The unit cannot be made compact or inexpensive.

SUMMARY OF THE INVENTION

Accordingly, it is an object of the present invention to provide a nonreciprocal circuit device which increases attenuation outside its frequency band to substantially reduce extraneous emission and which allows a communication unit to be made compact and inexpensive when used in the unit.

The foregoing object is achieved in one aspect of the present invention through the provision of a nonreciprocal circuit device including: a magnetic member to which a DC magnetic field is applied; a magnetic assembly in which a plurality of central conductors overlappingly intersecting each other are disposed on the magnetic member; and a matching capacitor connected between a port section of each of the central conductors and the ground, wherein at least one inductor is formed on a component member of the nonreciprocal circuit device, and the inductor is connected between at least one port section of the port sections of the central conductors and the input and output terminal electrode corresponding to the one port section.

The foregoing object is achieved in another aspect of the present invention through the provision of a nonreciprocal circuit device including: a magnetic assembly in which a plurality of central conductors overlappingly intersecting each other are disposed on a magnetic member to which a DC magnetic field is applied; a matching capacitor connected between a port section of each of the central conductors and the ground; and a spacer member for holding and securing components such as the magnetic assembly and the matching capacitors, wherein at least one inductor is formed on the spacer member, and the inductor is connected between at least one port section of the port sections of the central conductors and the input and output terminal corresponding to the one port section.

The foregoing object is achieved in still another aspect of the present invention through the provision of a nonreciprocal circuit device including: a magnetic assembly in which a plurality of central conductors overlappingly intersecting each other are disposed on a magnetic member to which a DC magnetic field is applied; a matching capacitor connected between a port section of each of the central conductors and the ground; and a spacer member for holding and securing components such as the magnetic assembly and the matching capacitors, wherein at least one inductor is formed on the spacer member, the inductor is connected between at least one port section of the port sections of the central conductors and the input and output terminal corresponding to the one port section, and a low-pass filter is formed of the inductor, the matching capacitor, and the electrode distribution capacitors of input and output transmission lines on a mounting board on which the nonreciprocal circuit device is mounted.

The foregoing object is achieved in yet another aspect of the present invention through the provision of a nonreciprocal circuit device in a magnetic circuit in which a permanent magnet is disposed in yokes including: a magnetic assembly in which a plurality of central conductors overlappingly intersecting each other are disposed on a magnetic member; a matching capacitor connected between a port section of each of the central conductors and the ground; and a resin case accommodating the matching capacitor and the magnetic assembly and having input and output terminals and a ground terminal; and a spacer member for stably holding and securing the magnetic assembly, the matching capacitor, and the resin case electrically and mechanically, wherein at least one inductor is formed on the spacer member, the inductor is connected between at least one port section of the port sections of the central conductors and the input and output terminal corresponding to the one port section, and a low-pass filter is formed of the inductor, the matching capacitor, and the electrode distribution capacitors of input and output transmission lines on a mounting board on which the nonreciprocal circuit device is mounted.

The nonreciprocal circuit device may be configured such that the inductor is formed of an electrode pattern made on a surface of or inside the spacer member.

The foregoing object is achieved in a further aspect of the present invention through the provision of a nonreciprocal circuit device including: a magnetic member to which a DC magnetic field is applied; a plurality of central conductors overlappingly intersecting each other and disposed on the magnetic member; a matching capacitor connected between a port section of each of the central conductors and the ground; and a terminal board on which input and output electrodes and a ground electrode are formed, wherein at least one inductor is formed on the terminal board, and the inductor is electrically connected between at least one port section of the port sections of the central conductors and the input and output terminal electrode corresponding to the one port section.

The nonreciprocal circuit device may be configured such that a low-pass filter is formed of the inductor, the matching capacitor, and electrode distribution capacitors of input and output transmission lines on a mounting board on which the nonreciprocal circuit device is mounted.

The nonreciprocal circuit device may be configured such that the inductor is formed of an electrode pattern made on a surface of or inside the terminal board.

The nonreciprocal circuit device may be configured such that a capacitor electrode which is electrically connected to the input and output electrode side of the inductor is formed on the terminal board, and a capacitor is formed by the capacitor electrode between the input and output electrode side of the inductor and the ground.

With the above structure, since the low-pass filter is formed of the inductor made on the spacer member or the terminal board, which is a component member of the nonreciprocal circuit device, the matching capacitor, and an external capacitor such as the electrode distribution capacitors of input and output transmission lines on a mounting board on which the nonreciprocal circuit device is mounted, attenuation outside the frequency band used can be substantially improved.

Since the inductor and the capacitor both used for making the low-pass filter can be formed on the nonreciprocal circuit device without changing the exterior dimensions, and the low-pass filter can be formed of the inductor, the capacitor, and an external capacitor such as an electrode distribution capacitor formed on a mounting board on which the nonreciprocal circuit device is mounted, the nonreciprocal circuit device according to the present invention substantially reduces extraneous emissions without using an additional filter for preventing extraneous emissions which is conventionally required.

DETAILED DESCRIPTION OF THE PREFERRED EMBODIMENTS

Embodiments of the present invention will be described below by referring to the accompanying drawings.

Figure 1:
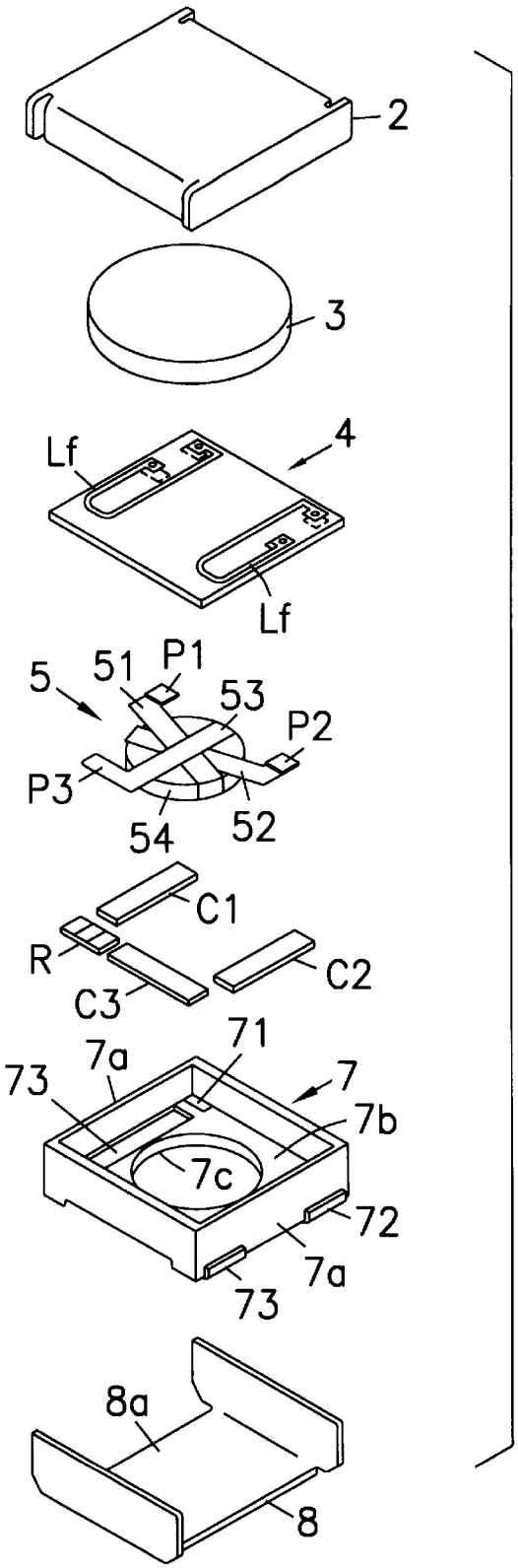
FIG. 1 is an exploded perspective view of an isolator according to a first embodiment of the present invention.
Figure 2:
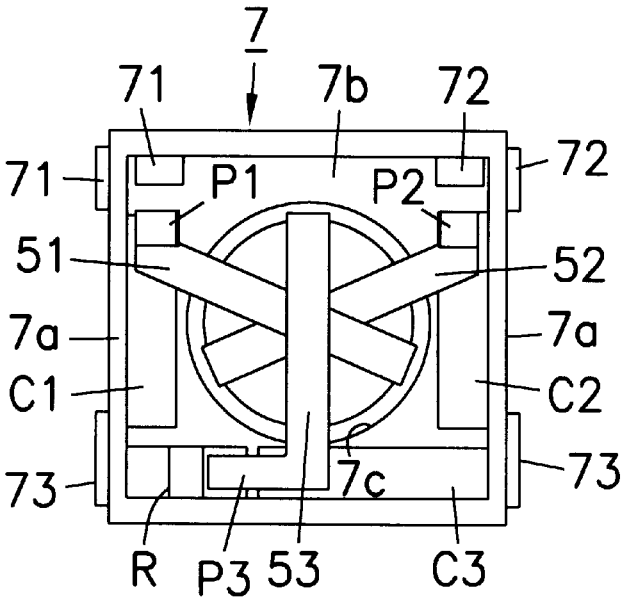
FIG. 2 is a plan of the isolator according to the first embodiment of the present invention.
Figure 3:
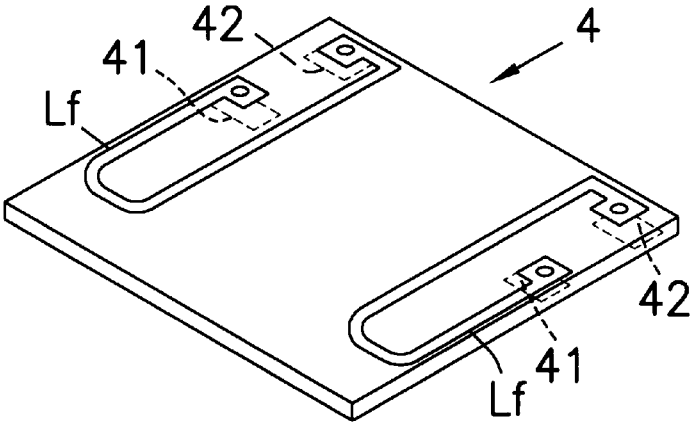
FIG. 3 is a perspective view of a spacer member according to the first embodiment of the present invention.
Figure 4:
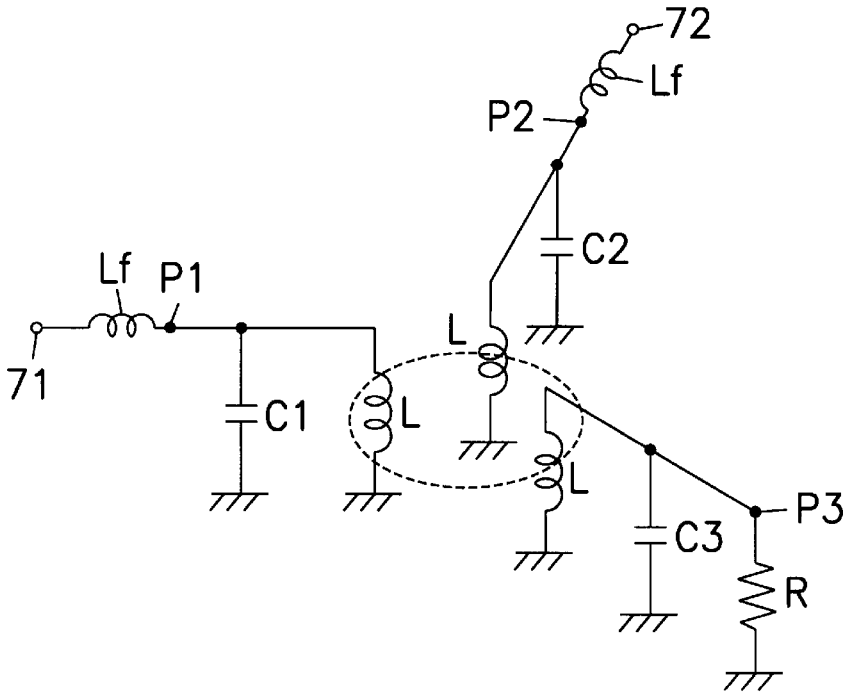
FIG. 4 is an equivalent circuit diagram of the isolator according to the first embodiment of the present invention.

FIGS. 1 to 4 show the structure of an isolator according to a first embodiment of the present invention. FIG. 1 is an exploded perspective view of the isolator, FIG. 2 is a plan of the isolator with a spacer member, a permanent magnet, and an upper yoke being removed, FIG. 3 is a perspective view of the spacer member, and FIG. 4 is an equivalent circuit diagram of the isolator. Matching capacitors and inductor electrodes shown in FIGS. 1 and 2 correspond to matching capacitors and inductors shown in FIG. 4, and the same symbols are used.

As shown in FIGS. 1 to 3, in the isolator of the present embodiment, a permanent magnet 3 is disposed inside a box-shaped upper yoke 2 made from a magnetic metal, and a lower yoke 8 having an almost U shape and made from a magnetic metal is mounted thereto to form a magnetic closed circuit. A resin case 7 is disposed on the upper surface 8*a* of the lower yoke 8, and the resin case 7 encloses a magnetic assembly 5, matching capacitors C1 to C3, and a terminating resistor R. A quadrangle-shaped spacer member 4 is disposed between the permanent magnet 3 and the magnetic assembly 5 and the permanent magnet 3 applies a DC magnetic field to the magnetic assembly 5.

The spacer member 4 is formed of a glass-epoxy, plastic, or Teflon printed circuit board, or a liquid-crystal-polymer resin plate on which a plating electrode is formed or in which a metallic plate is insert-molded. Since the spacer member fills gaps inside the isolator and has a spring characteristic, the components disposed inside the isolator are stably held and secured. As shown in an enlarged view in FIG. 3, two inductor electrodes Lf made from hairpin-shaped electrode patterns are formed on one main surface (the upper surface in the figure), and connection electrodes 41 and 42 are formed at positions corresponding to respective ends of each inductor electrode Lf on the other main surface (the lower surface in the figure). Both ends of each inductor electrode Lf are electrically connected to the connection electrodes 41 and 42 by through holes.

In the magnetic assembly 5, the ground sections of three central conductors 51 to 53 made of thin metallic plates contact the lower surface of a circular ferrite 54 and the three central conductors 51 to 53 are bent and disposed on the upper surface of the ferrite 54 through an insulating sheet (not shown) such that they overlappingly intersect each other at 120 degrees. Port sections P1 to P3 at the tips of the central conductors 51 to 53 protrude outward.

The resin case 7 is made from an electrically insulating member. A rectangular frame-shaped side wall 7*a* is integrated with a bottom wall 7*b*. Input and output terminals 71 and 72 and ground terminals 73 are partly embedded in the resin case 7. At nearly the center of the bottom wall 7*b*, a hole 7*c* is formed, and recessed portions are made at specified positions surrounding the hole 7*c* in order to accommodate the matching capacitors C1 to C3 and the terminating resistor R. The input and output terminals 71 and 72 are disposed at both corners of one side of the resin case 7 such that one end of each terminal is exposed through the upper surface of the bottom wall 7*b* and the other end is exposed through the lower surface of the bottom wall 7*b* and the external surface of the side wall 7*a*. The ground terminals 73 are disposed at the other side of the resin case 7 such that one end of each terminal is exposed through the inner surfaces of the recessed portions on the bottom wall 7*b*, where the capacitors C1 to C3 and the terminating resistor R are disposed, and the other end is exposed through the lower surface of the bottom wall 7*b* and the external surface of the side wall 7*a*.

At the recessed portions formed in the peripheral section of the hole 7*c*, the matching chip capacitors C1 to C3, and the terminating chip resistor R are disposed. The magnetic assembly 5 is inserted into the hole 7*c* and the spacer member 4 is disposed so as to cover the whole upper surface of the magnetic assembly 5.

The ground sections of the central conductors 51 to 53 disposed at the lower surface of the magnetic assembly 5 are connected to the upper surface 8*a* of the lower yoke 8. The lower electrode of each of the capacitors C1 to C3 and one electrode of the terminating resistor R are connected to the ground terminals 73. The upper electrodes of the capacitors C1 to C3 are connected to the port sections P1 to P3 of the central conductors 51 to 53, and the other end of the terminating resistor R is connected to a port section P3.

Connection electrodes 41, which are formed at the lower surface of the spacer member 4 and are electrically connected to one end of each of the inductor electrodes Lf, are connected to the port sections P1 and P2 of central conductors 51 and 52. Connection electrodes 42, which are electrically connected to the other ends of the inductor electrodes Lf, are connected to the sections of the input and output terminals 71 and 72 exposed through the upper surface of the bottom wall 7*b*.

When the upper yoke 2 fits in the lower yoke 8, the permanent magnet 3 presses and secures the magnetic assembly 5 and the resin case 7 to the lower yoke 8 through the spacer member 4, and the matching capacitors C1 to C3 and the terminating resistor R are pressed into the recessed portions of the resin case 7. In addition, the spacer member 4 presses and secures the port sections P1 to P3 of the central conductors 51 to 53 to the matching capacitors C1 to C3, and the terminating resistor R.

As described above, the port sections P1 and P2 of central conductors 51 and 52 are connected to the input and output terminals 71 and 72 through the inductor electrodes Lf formed on the spacer member 4. As shown in the equivalent circuit diagram in FIG. 4, in the isolator of the present embodiment, the port sections P1 to P3 of the central conductors 51 to 53 are connected to the matching capacitors C1 to C3, a port section P3 is connected to the terminating resistor R, and the inductors Lf are connected between port sections P1 and P2 and the input and output terminals 71 and 72.

Figure 5:
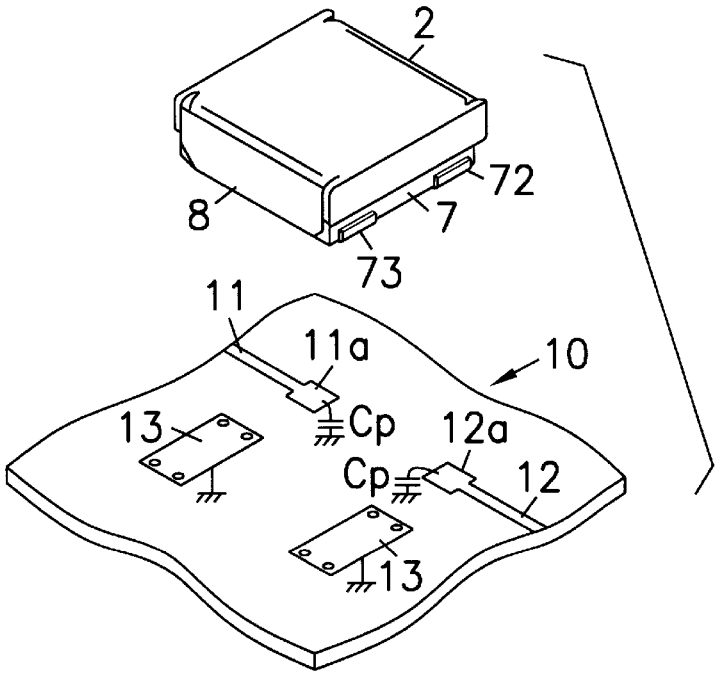
FIG. 5 is a perspective view showing a condition in which the isolator according to the first embodiment of the present invention is mounted.

This isolator is surface-mounted to a mounting board 10 in which input and output transmission lines 11 and 12 and ground electrodes 13 are formed on the front surface and a ground electrode is formed on almost the whole area of the rear surface, as shown in FIG. 5. Specifically, the input and output terminals 71 and 72 of the isolator are soldered to soldering lands 11*a* and 12*a* of the transmission lines 11 and 12. The ground terminals 73 are soldered to the ground electrodes 13. The soldering lands 11*a* and 12*a*, to which the input and output terminals 71 and 72 of the isolator are soldered, are formed wider than the other portions of the transmission lines so as to obtain sufficient mounting strength (soldering strength). Between the soldering lands 11*a* and 12*a* and the ground electrode formed on the rear surface, stray capacitors Cp are inevitably generated.

Figure 6:
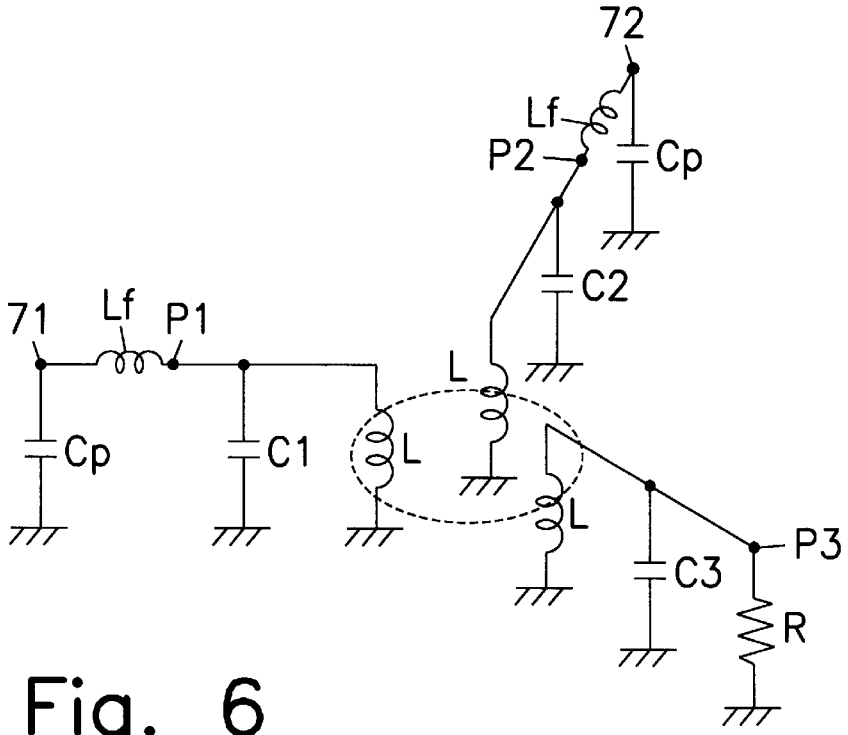
FIG. 6 is an equivalent circuit diagram of a system in which the isolator according to the first embodiment of the present invention is mounted on a board.
Figure 7:
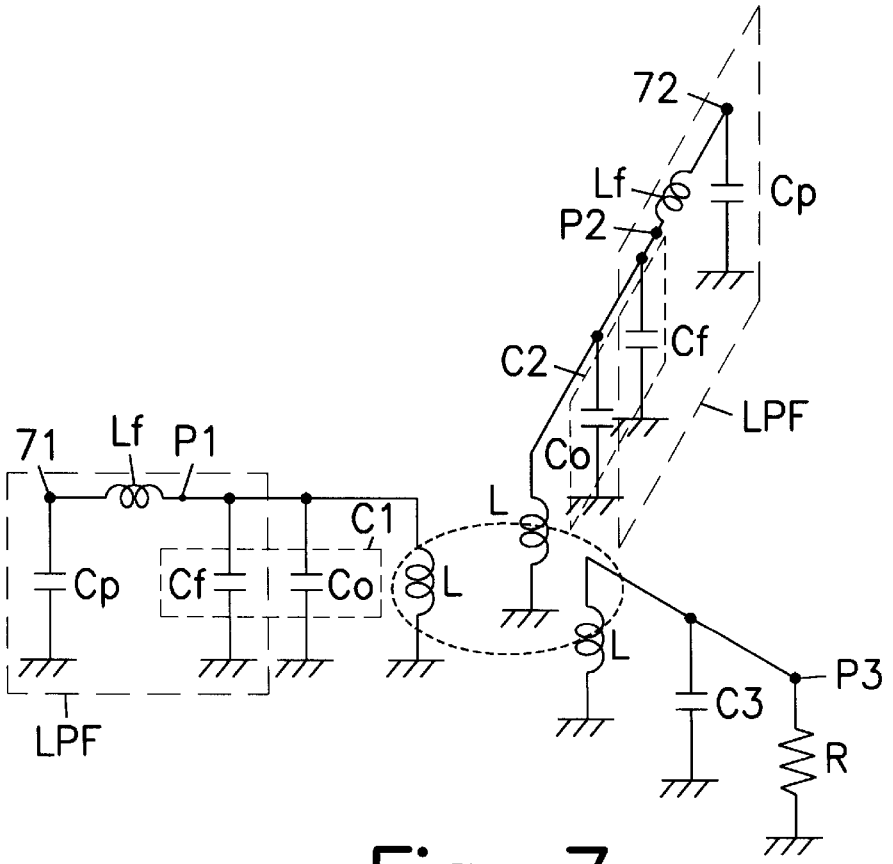
FIG. 7 is an equivalent circuit diagram used for describing the operation of the system in which the isolator according to the first embodiment of the present invention is mounted on the board.

The operation of the isolator according to the present embodiment will be described below. FIGS. 6 and 7 are equivalent circuit diagrams of the isolator in a condition in which it is mounted on the mounting board 10. FIG. 7 is an equivalent circuit diagram used for describing the operation principle of the isolator when mounted.

When the isolator is mounted on the mounting board 10 (as shown in FIG. 5), the stray capacitors Cp, parasitically generated at the soldering lands 11*a* and 12*a* of the transmission lines 11 and 12 on the mounting board 10, are connected to the signal input and output terminals 71 and 72 of the isolator, as shown in FIG. 6. At the signal input and output sections (ports P1 and P2) of the isolator, π-type low-pass filters LPFs formed of the inductors Lf, capacitors Cf which are part of the matching capacitors C1 and C2, and the stray capacitors Cp of the mounting board 10, which are external capacitors, are created as shown in FIG. 7.

Matching capacitors C1 and C2 of the isolator are formed of parallel capacitors, capacitors Co which function as matching circuits for the isolator and the capacitors Cf, which form the π-type low-pass filter LPFs. In other words, matching capacitors C1 and C2 are specified such that they have capacitances obtained by adding capacitance Cf to a matching capacitance Co of the conventional isolator. In the 1.5 GHz band, for example, the capacitance Co is set to about 5 pF and the capacitance Cf is set to about 2 pF. In the 900 MHz band, the capacitance Co is set to about 10 pF and the capacitance Cf is set to about 3 pF. The inductance Lf is set to about 2 to 3 nH.

The capacitance Cf is usually set to the same value as the capacitance of the stray capacitors Cp so that the input and output impedance (usually 500Ω) of the isolator does not change. When the capacitance Cf is set to a value different from the stray capacitance Cp, the input and output impedance of the isolator is changed.

The inductance Lf can be set to any value by changing the width and shape of the electrode pattern of the inductor electrode Lf formed on the spacer member 4.

The capacitance Cf, the stray capacitance Cp, and the inductance Lf are specified appropriately according to the thickness, the frequency band to be used, the electric characteristics, and the mounting strength of the mounting board.

Figure 8:
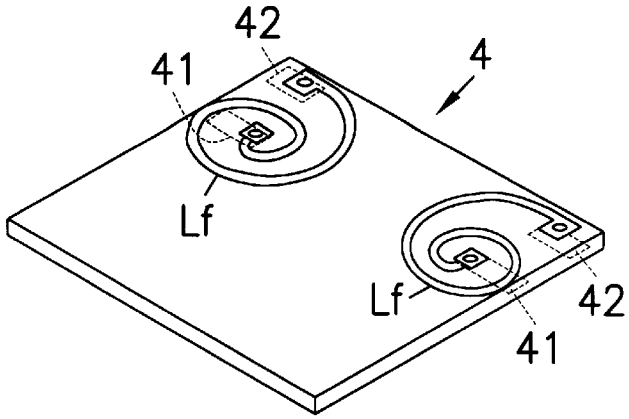
FIG. 8 is a perspective view of another spacer member according to the present invention.

The shapes of the spacer member 4 and the inductor electrodes Lf are not limited to those in the above embodiment. For example shape of the inductor electrodes Lf may be a spiral pattern as shown in FIG. 8. Further, the shape of the spacer member 4 is not limited to a flat plate shape. It may be a plate having recessed and protruded portions or having holes so as to press and secure components more stably and more positively. The spacer may be configured such that it has multiple layers and the inductor electrodes Lf are formed inside the spacer member.

Figure 11:
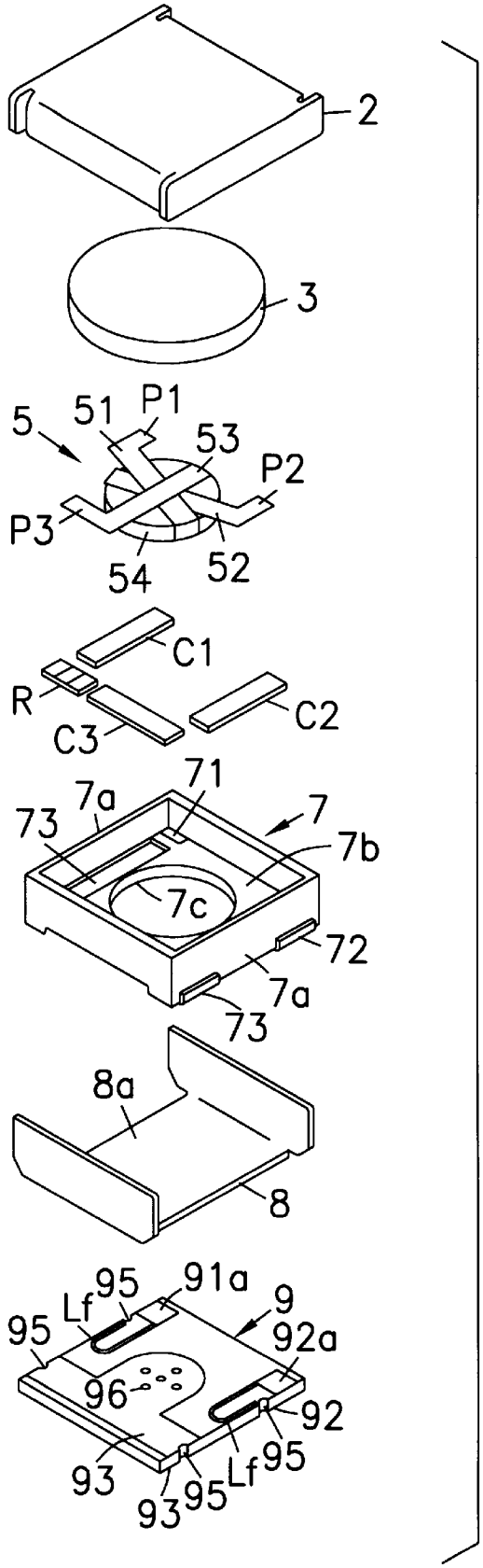
Fig. 11 Prior Art
FIG. 11 is an exploded perspective view of an isolator according to a second embodiment of the present invention.
Figure 12:
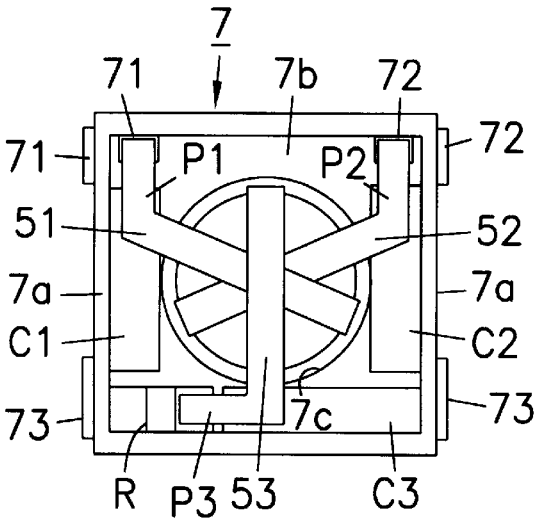
FIG. 12 is a plan of the isolator according to the second embodiment of the present invention.
Figure 13A:
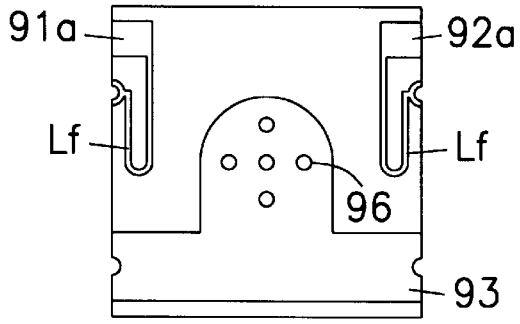
FIG. 13A is a top view of a terminal board according to the second embodiment of the present invention.
Figure 13B:
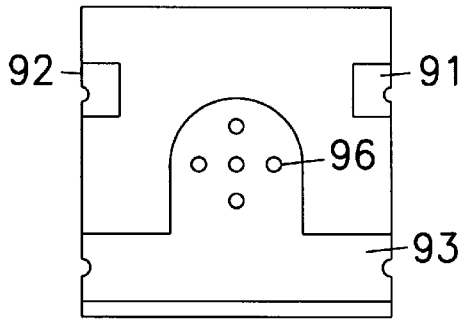
FIG. 13B is a bottom view of the terminal board.
Figure 14:
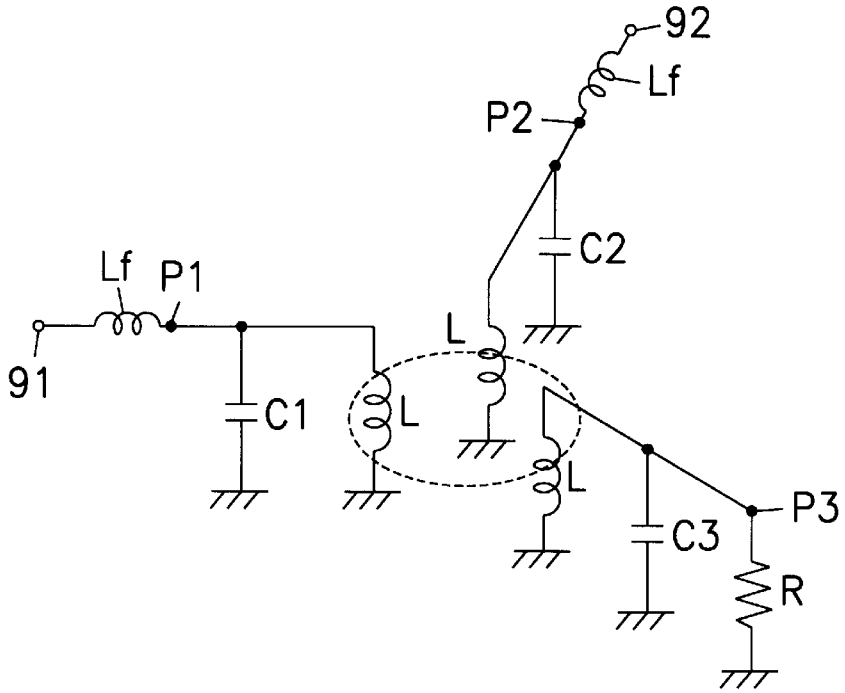
FIG. 14 is an equivalent circuit diagram of the isolator according to the second embodiment of the present invention.

FIGS. 11 to 14 show the structure of an isolator according to a second embodiment of the present invention. FIG. 11 is an exploded perspective view of the isolator, FIG. 12 is a plan of the isolator with a permanent magnet, an upper yoke, and a terminal board being removed, FIG. 13A is a top view of the terminal board, FIG. 13B is a bottom view of the terminal board, and FIG. 14 is an equivalent circuit diagram of the isolator. Matching capacitors and inductor electrodes shown in FIGS. 11 and 12 correspond to matching capacitors and inductors shown in FIG. 14, and the same symbols are used.

As shown in FIGS. 11 to 13, in the isolator of the present embodiment, a permanent magnet 3 is disposed inside a box-shaped upper yoke 2 made from a magnetic metal, and a lower yoke 8 having an almost U shape and made from a magnetic metal is mounted thereto to form a magnetic closed circuit. A resin case 7 is disposed on the upper surface 8*a* of the lower yoke 8, and the resin case 7 encloses a magnetic assembly 5, matching capacitors C1 to C3, and a terminating resistor R. A terminal board 9 is disposed on the lower surface of the lower yoke 8, and the permanent magnet 3 applies a DC magnetic field to the magnetic assembly 5.

In the magnetic assembly 5, the ground sections of three central conductors 51 to 53 made of thin metallic plates contact the lower surface of a circular ferrite 54 and the three central conductors 51 to 53 are bent and disposed on the upper surface of the ferrite 54 through an insulating sheet (not shown) such that they overlappingly intersect each other at 120 degrees. Port sections P1 to P3 at the tips of the central conductors 51 to 53 protrude outward.

The resin case 7 is made from an electrically insulating member. A rectangular frame-shaped side wall 7*a* is integrated with a bottom wall 7*b*, and input and output terminals 71 and 72 and ground terminals 73 are disposed at specified positions. At nearly the center of the bottom wall 7*b*, a hole 7*c* is formed, and recessed portions are formed specified positions the around the hole 7*c* in order to accommodate the matching capacitors C1 to C3 and the terminating resistor R. The input and output terminals 71 and 72 and the ground terminals 73 are disposed such that their center sections are embedded in the resin, one end of each terminal is exposed through the upper surface of the bottom wall 7*b*, and the other end is exposed through the lower surface of the bottom wall 7*b* and the external surface of the side wall 7*a*.

The terminal board 9 is formed of a glass-epoxy, plastic, or Teflon printed circuit board, a liquid-crystal-polymer resin plate, or an alumina ceramic board. As shown in FIGS. 11 and 13A, two inductor electrodes Lf made of hairpin-shaped electrode patterns, connection electrodes 91*a* and 92*a* at one end of each of the inductor electrodes Lf, and a ground electrode 93 are formed on one main surface (the upper surface in FIG. 11), and as shown in FIG. 13B input and output electrodes 91 and 92 and a ground electrode 93 are formed on the other main surface (the lower surface in FIG. 11). The other ends of the inductor electrodes Lf are connected to the input and output electrodes 91 and 92 through end-face electrodes 95, and the ground electrodes 93 formed on the upper and lower surfaces are connected through end-face electrodes 95 and through holes 96.

At the recessed portions formed around the hole 7*c* in the resin case 7, the matching chip capacitors C1 to C3 and the terminating chip resistor R are disposed. The magnetic assembly 5 is inserted into the hole 7*c*. The ground sections of the central conductors 51 to 53 disposed at the lower surface of the magnetic assembly 5 are connected to the upper surface 8*a* of the lower yoke 8. The lower electrode of each of the capacitors C1 to C3 and one electrode of the terminating resistor R are connected to the ground terminals 73.

The upper electrodes of the capacitors C1 to C3 are connected to the port sections P1 to P3 of the central conductors 51 to 53, and the other end of the terminating resistor R is connected to a port section P3. The port sections P1 and P2 of the input and output central electrodes 51 and 52 are connected to the sections of the input and output terminals 71 and 72 exposed through the upper surface of the bottom wall 7*b*.

The other ends of the input and output terminals 71 and 72 in the resin case 7 are connected to the connection electrodes 91*a* and 92*a* of the terminal board 9, and the ground terminals 73 are connected to the ground electrodes 93.

As described above, the port sections P1 and P2 of the input and output central conductors 51 and 52 are connected to the input and output electrodes 91 and 92 through the input and output terminals 71 and 72 and the inductor electrodes Lf formed on the terminal board 9. As shown in the equivalent circuit diagram in FIG. 14, in the isolator of the present embodiment, the port sections P1 to P3 of the central conductors 51 to 53 are connected to the matching capacitors C1 to C3, a port section P3 is connected to the terminating resistor R, and the inductors Lf are connected between two port sections P1 and P2 and the input and output electrodes 91 and 92.

Figure 15:
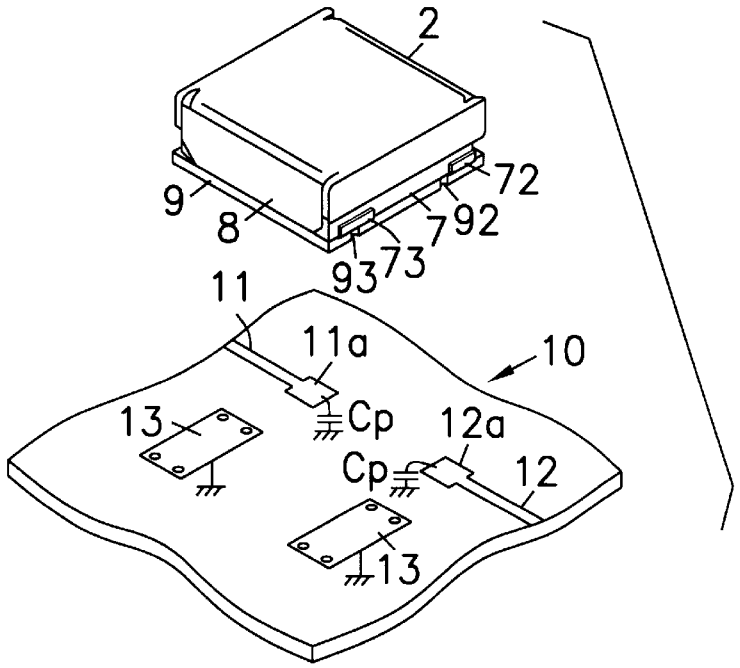
FIG. 15 is a perspective view showing a condition in which the isolator according to the second embodiment of the present invention is mounted.

This isolator is surface-mounted to a mounting board 10 of which input and output transmission lines 11 and 12 and ground electrodes 13 are formed on the front surface and a ground electrode is formed almost the whole area of the rear surface, as shown in FIG. 15. Specifically, the input and output electrodes 91 and 92 of the isolator are soldered to soldering lands 11*a* and 12*a* of the transmission lines 11 and 12. The ground electrodes 93 of the isolator are soldered to the ground electrodes 13 on the mounting board 10. The soldering lands 11*a* and 12*a*, to which the input and output electrodes 91 and 92 of the isolator are soldered, are formed wider than the other portions of the transmission lines so as to obtain sufficient mounting strength (soldering strength). Between the soldering lands 11*a* and 12*a* and the ground electrode formed on the rear surface, stray capacitors Cp are inevitably generated.

Figure 16:
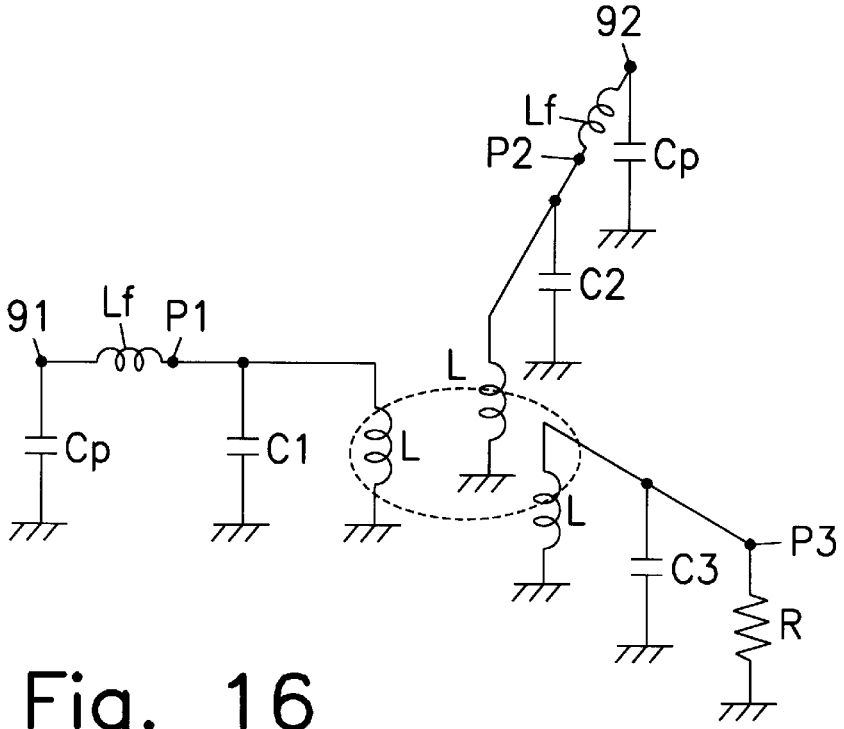
FIG. 16 is an equivalent circuit diagram of a system in which the isolator according to the second embodiment of the present invention is mounted on a board.
Figure 17:
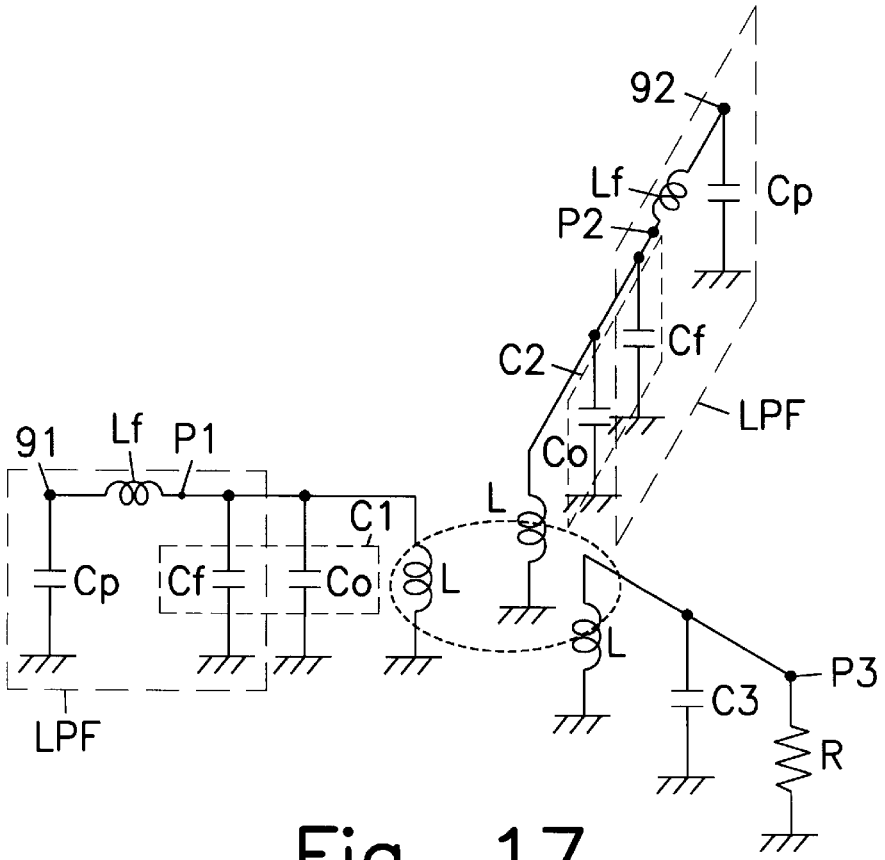
FIG. 17 is an equivalent circuit diagram used for describing the operation of the system in which the isolator according to the second embodiment of the present invention is mounted on the board.

The operation of the isolator according to the present embodiment will be described below. FIGS. 16 and 17 are equivalent circuit diagrams of the isolator in a condition in which it is mounted on the mounting board 10. FIG. 17 is an equivalent circuit diagram used for describing the operation principle of the isolator when mounted.

When the isolator is mounted on the mounting board 10 (as shown in FIG. 15), the stray capacitors Cp, parasitically generated at the soldering lands 11*a* and 12*a* of the transmission lines 11 and 12 on the mounting board 10, are connected to the input and output electrodes 91 and 92 of the isolator, as shown in FIG. 16. At the signal input and output sections (ports P1 and P2) of the isolator, π-type low-pass filters (LPFs) formed of the inductors Lf, capacitors Cf which are part of the matching capacitors C1 and C2, and the stray capacitors Cp of the mounting board 10, which are external capacitors, are created as shown in FIG. 17.

Matching capacitors C1 and C2 of the isolator are formed of parallel capacitors, capacitors Co which function as matching circuits for the isolator and the capacitors Cf, which form the π-type low-pass filter LPFs. In other words, matching capacitors C1 and C2 are specified such that they have a capacitance obtained by adding capacitance Cf to a matching capacitance Co of the conventional isolator. In the 1.5 GHz band, for example, the capacitance Co is set to about 5 pF and the capacitance Cf is set to about 2 pF. In the 900 MHz band, the capacitance Co is set to about 10 pF and the capacitance Cf is set to about 3 pF. The inductance Lf is set to about 2 to 3 nH.

The capacitance Cf is usually set to the same value as the capacitance of the stray capacitors Cp so that the input and output impedance (usually 500Ω) of the isolator does not change. The input and output impedance of the isolator can be changed by appropriately setting the inductance Lf, the capacitance Cf, and the stray capacitance Cp.

The shape of the inductors Lf is not limited to a hairpin shape. It may be a loop shape. The inductance Lf can be set to any value by changing the width and shape of the electrode pattern of the inductor electrode Lf.

The capacitance Cf, the stray capacitance Cp, and the inductance Lf are specified appropriately according to the thickness, the frequency band to be used, the electric characteristics, and the mounting strength of the mounting board.

Figure 18:
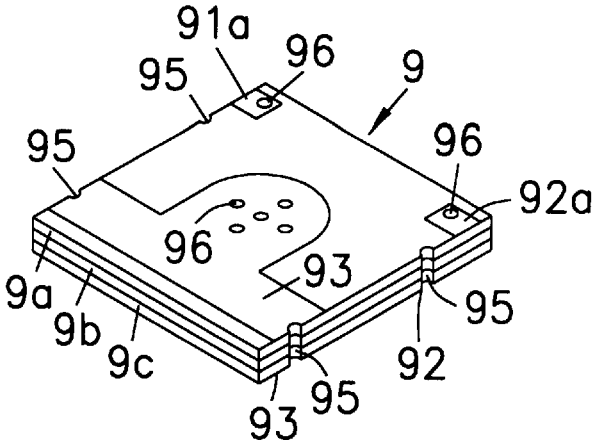
FIG. 18 is a perspective view of an isolator according to a third embodiment of the present invention.
Figure 19A:
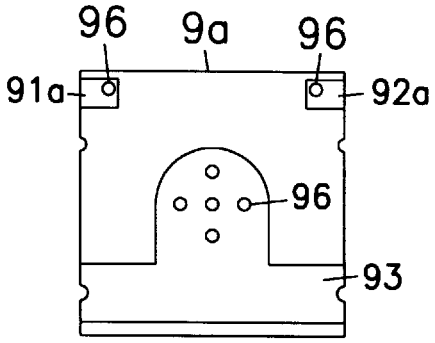
FIG. 19A is a top view of a first-layer board of a terminal board according to the third embodiment of the present invention.
Figure 19C:
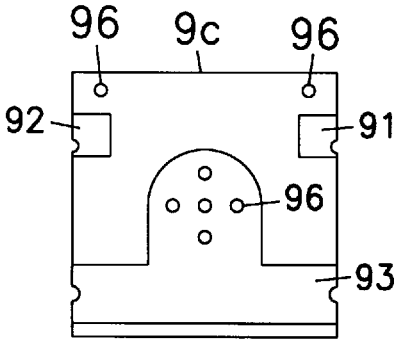
FIG. 19C is a bottom view of a third-layer board.
Figure 19B:
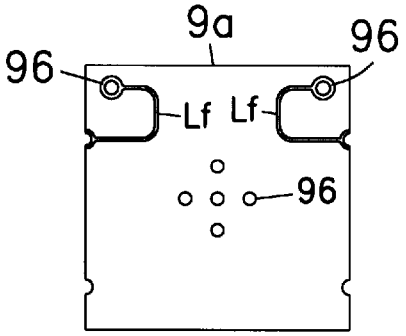
FIG. 19B is a bottom view of the first-layer board.

FIGS. 18 and 19 show the structure of a terminal board according to a third embodiment of the present invention. FIG. 18 is a perspective view of the multi-layer terminal board, FIG. 19A is a top view of the first layer of the terminal board 9, FIG. 19B is a bottom view of the first layer, and FIG. 19C is a bottom view of a third layer.

The terminal board 9 of the present embodiment is a multi-layer board in which three printed circuit boards 9*a*, 9*b*, and 9*c* are put together by pressure. As shown in FIGS. 18 and 19A, connection electrodes 91*a* and 92*a* and a ground electrode 93 are formed on the upper surface of the first-layer board 9*a*, approximately U-shaped inductor electrodes Lf are formed on the lower surface of the first-layer board 9*a*, and input and output electrodes 91 and 92 and a ground electrode 93 are formed on the lower surface of the third-layer board 9*c*. One end of each of the inductor electrodes Lf is connected to a connection electrode 91*a* or 92*a* by through holes 96, and the other ends are connected to the input and output electrodes 91 and 92 through end-face electrodes 95. The ground electrodes 93 are connected through end-face electrodes 95 and through holes 96. The second-layer board 9*b* is used for combining the first-layer board 9*a* and the third-layer board 9*c* and is not provided with electrodes on the upper or lower surface.

The inductor electrodes Lf are formed inside the multilayer board 9 in the present embodiment. When the inductor electrodes Lf are formed inside the board 9 as described above, the electrodes can have various shapes and the degree of freedom in designing the inductors can be increased.

FIG. 20 shows the structure of a terminal board according to a fourth embodiment of the present invention. The terminal board 9 of the present embodiment is a three-layer board in the same way as in the third embodiment. FIG. 20A is a top view of the first layer of the terminal board 9, FIG. 20B is a bottom view of the first layer, FIG. 20C is a top view of the third layer, and FIG. 20D is a bottom view of the third layer.

Figure 20A:
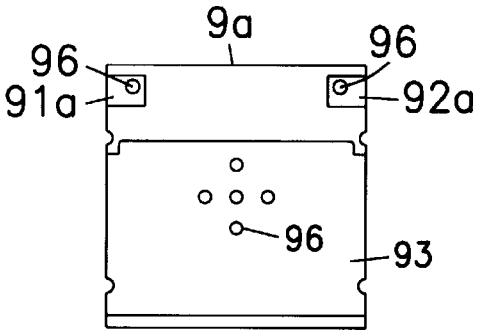
FIG. 20A is a top view of a first-layer board of a terminal board according to a fourth embodiment of the present invention.
Figure 20B:
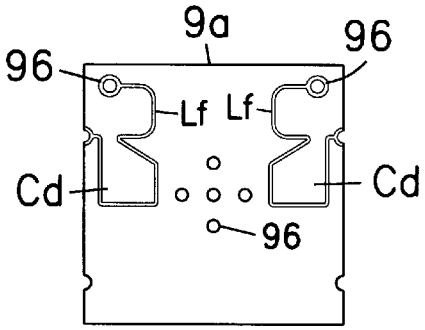
FIG. 20B is a bottom view of the first-layer board.
Figure 20C:
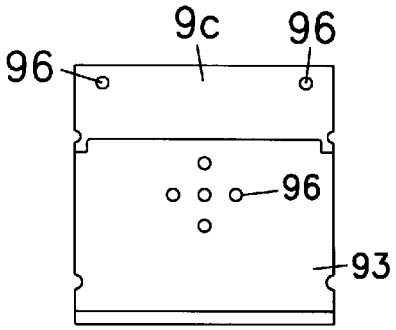
FIG. 20C is a top view of a third-layer board.
Figure 20D:
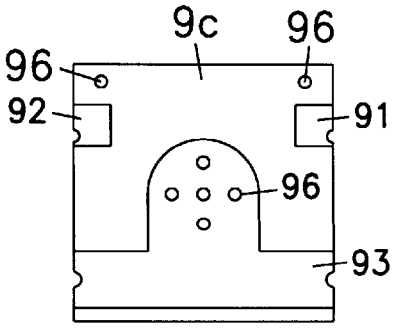
FIG. 20D is a bottom view of the third-layer board.
Figure 22:
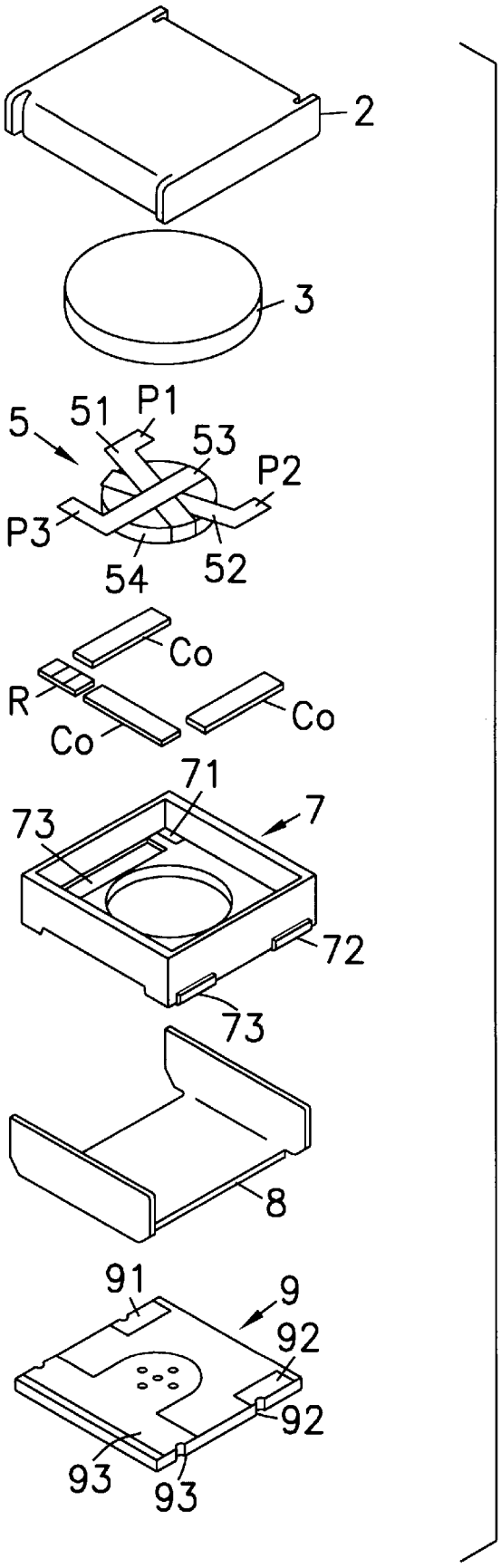
Fig. 22 Prior Art
FIG. 22 is an exploded perspective view of a second conventional isolator.

On the lower surface of the first-layer board 9*a* in the terminal board 9, capacitor electrodes Cd are formed so as to connect to the inductor electrodes Lf at the position where the input and output electrodes 91 and 92 are connected, as shown in FIG. 20B. Between the capacitor electrodes Cd and the ground electrode 93 on the upper surface of the first-layer board 9*a* and between the capacitor electrodes Cd and the ground electrode 93 of the upper surface of the third board, capacitors are formed. The capacitors are part of the capacitors of the π-type low-pass filters (LPFs) at the input and output electrode sides. When the isolator is mounted on a mounting board, the capacitors are connected in parallel to the stray capacitors Cp of the mounting board.

With the use of the terminal board 9 of the present embodiment, one capacitor of each π-type low-pass filter LPF is formed of parallel capacitors, a stray capacitor Cp of the mounting board and a capacitor of the capacitor electrode Cd, and the area required for the soldering lands on the mounting board can be reduced.

Since the degree of freedom in specifying the capacitance of the π-type low-pass filters LPFs is increased by the use of the isolator of the present embodiment, more-suitable low-pass filters (LPFs) can be configured. The soldering lands of the mounting board can have the most suitable shape (area).

Figure 21:
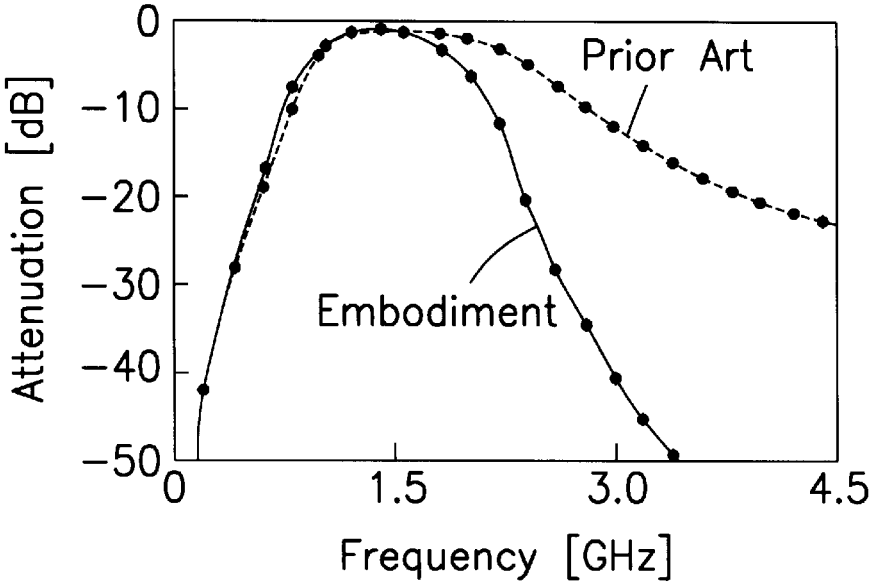
FIG. 21 is a chart showing frequency characteristics of a conventional isolator and an isolator according to one embodiment of the present invention.
Figure 9:
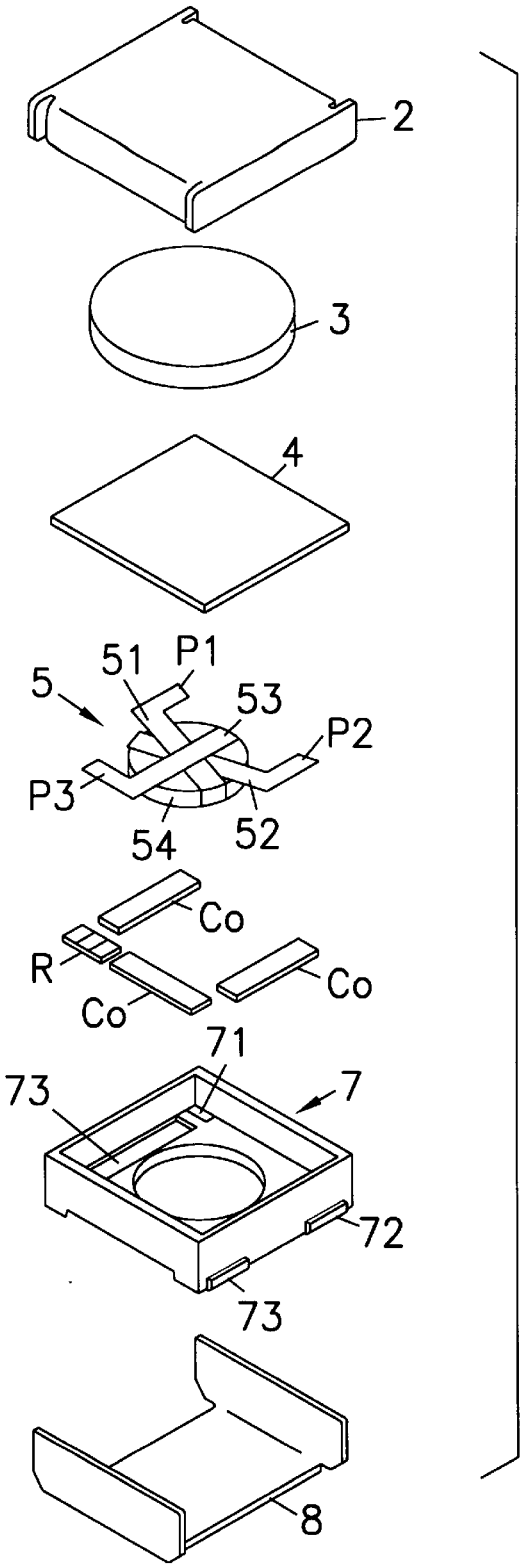
Fig. 9 Prior Art
FIG. 9 is an exploded perspective view of a conventional isolator.
Figure 10:
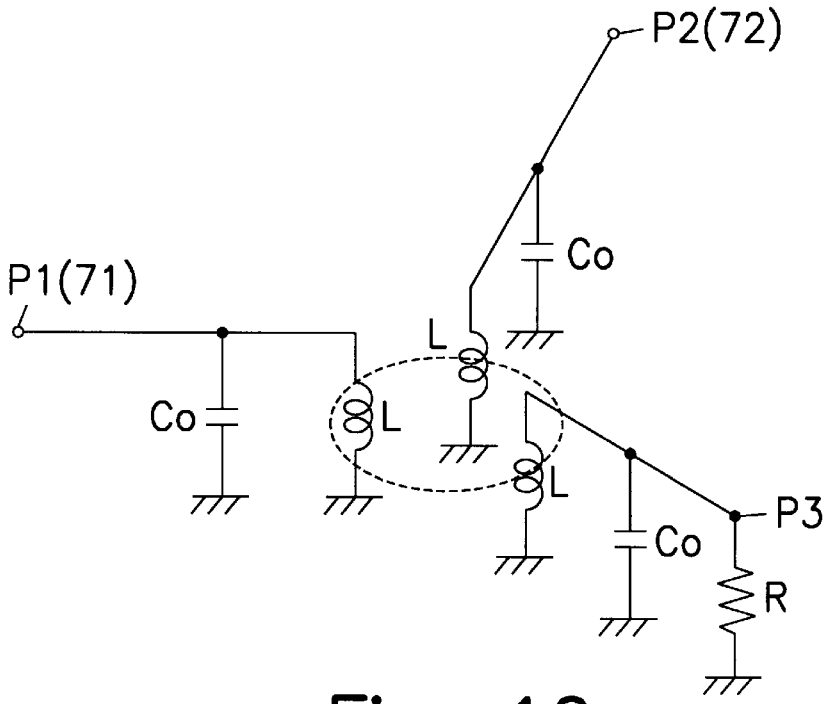
Fig. 10 Prior Art
FIG. 10 is an equivalent circuit diagram of the conventional isolator of FIG. 9.
Figure 23:
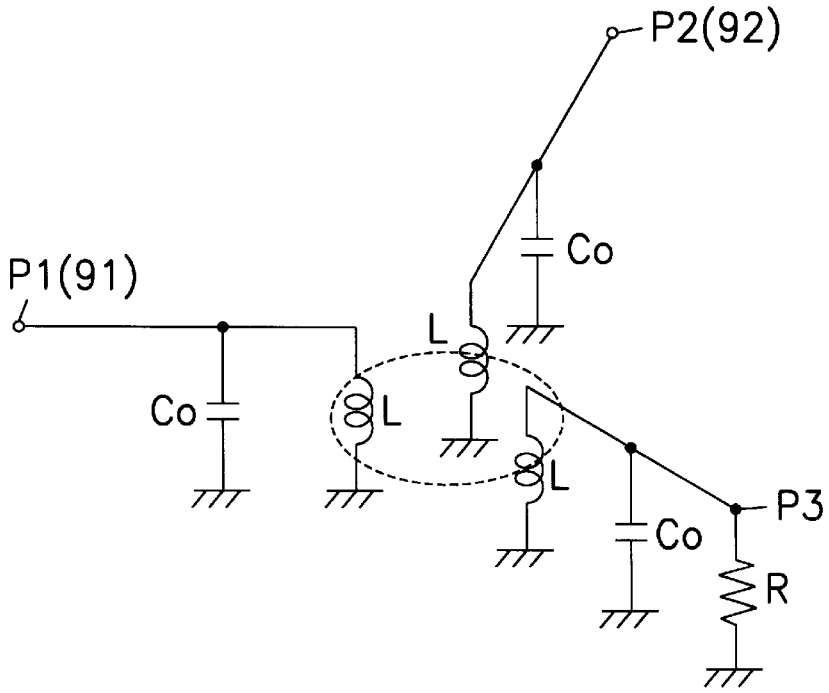
Fig. 23 Prior Art
FIG. 23 is an equivalent circuit diagram of the conventional isolator of FIG. 22.

FIG. 21 is a chart showing the frequency characteristics of a conventional isolator and an isolator according to one embodiment of the present invention when they are mounted on a mounting board. The solid line indicates the characteristics of the isolator according to the embodiment, and the dotted line indicates the characteristics of the conventional isolator. As shown in FIG. 21, attenuation in the blocking zone at the high frequency side is substantially large with the use of the isolator of the embodiment as compared with a case in which the conventional isolator is used.

As described above, in the isolators according to the embodiments, the inductors Lf are formed on the spacer member 4 or the terminal board 9. When an isolator of the present invention is mounted on the mounting board 10, since the low-pass filters (LPFs) are formed of the inductors Lf, the matching capacitor C1 (or C2), and the stray capacitors Cp on the mounting board 10 at the signal input and output sections, attenuation outside the frequency band used is substantially improved as shown in FIG. 21.

An isolator according to the present invention includes the inductors Lf and the capacitors Cf both used to form low-pass filters (LPFs), without changing the exterior dimensions. On the mounting board 10, the stray capacitors Cp used to form the low-pass filters (LPFs) are inevitably formed at the soldering lands 11*a* and 12*a*. With the use of the isolator of the present invention, extraneous emissions can be substantially reduced without using an additional filter for preventing extraneous emissions which is conventionally required, and the isolator allows a communication unit to be made compact and inexpensive when used in the unit.

In the above embodiments, the stray capacitors formed at the soldering lands of the mounting board are used as external capacitors. The external capacitors are not limited to those capacitors. A chip capacitor may be used.

Two inductor electrodes Lf are formed on the spacer member 4 or the terminal board 9 in the above embodiments. The form of the inductor electrodes is not limited to those cases. An inductor electrode Lf may be formed only at one of the signal input and output sides.

Isolators have been described in the above embodiments. The present invention can also be applied to a circulator which uses a port P3 as the third input and output section without connecting a terminating resistor R to the port P3.

The whole configuration is not limited to those shown in FIGS. 1 and 2, and FIGS. 11 and 12. The present invention is characterized in that an inductor used to form a low-pass filter is formed on a spacer member for stably holding and securing components disposed inside a nonreciprocal circuit device. Instead of the spacer member, a terminal board may be used. Other configurations are not limited.

What is claimed is:

1. A nonreciprocal circuit device comprising:

a magnetic assembly in which a plurality of central conductors overlappingly intersecting and insulated from each other are disposed on a magnetic member for receiving a DC magnetic field;

a matching capacitor connected between a port section of each of said central conductors and ground, each said port section being connected to a respective terminal of the nonreciprocal circuit device; and a spacer member for holding and securing said magnetic assembly and matching capacitors, wherein at least one inductor is formed on said spacer member, said inductor is connected between at least one of the port sections of said central conductors and the terminal corresponding to said one port section, said nonreciprocal circuit device being mounted on a mounting board having thereon input and output transmission lines, and a low-pass filter is formed of said inductor, the corresponding said matching capacitor, and stray capacitance formed by said input and output transmission lines on said mounting board on which said nonreciprocal circuit device is mounted.

2. A nonreciprocal circuit device in a magnetic circuit formed by a permanent magnet disposed within yokes, said nonreciprocal circuit device comprising:

a magnetic assembly in which a plurality of central conductors overlappingly intersecting and insulated from each other are disposed on a magnetic member;

a matching capacitor connected between a port section of each of said central conductors and ground, each said port section being connected to a respective terminal of the nonreciprocal circuit device; and a resin case accommodating said matching capacitors and said magnetic assembly and having said input/output terminals and a ground terminal thereon; and a spacer member for stably holding and securing said magnetic assembly, said matching capacitors, and said resin case, wherein at least one inductor is formed on said spacer member, said inductor is connected between at least one of the port sections of said central conductors and the input/output terminal corresponding to said one port section, said nonreciprocal circuit device being mounted on a mounting board having thereon input and output transmission lines, and a low-pass filter is formed of said inductor, the corresponding said matching capacitor, and stray capacitance formed by said input and output transmission lines on said mounting board on which said nonreciprocal circuit device is mounted.

3. A nonreciprocal circuit device according to one of claims 1 and 2, wherein said inductor is formed of an electrode pattern disposed on a surface of said spacer member.

4. A nonreciprocal circuit device according to one of claims 3 and 4, wherein said inductor is formed of an electrode pattern disposed inside said spacer member.

5. A nonreciprocal circuit device comprising:

a magnetic member for receiving a DC magnetic field;

a plurality of central conductors overlappingly intersecting and insulated from each other and disposed on said magnetic member;

a matching capacitor connected between a port section of each of said central conductors and ground, each said port section being connected to a respective terminal of the nonreciprocal circuit device; and a terminal board on which said terminals and a ground electrode are formed, wherein at least one inductor is formed on said terminal board, said inductor being electrically connected between at least one of the port sections of said central conductors and the terminal corresponding to said one port section, said nonreciprocal circuit device being mounted on a mounting board having thereon input and output transmission lines, and wherein a low-pass filter is formed of said inductor, the corresponding said matching capacitor, and stray capacitance formed by said input and output transmission lines on said mounting board on which said nonreciprocal circuit device is mounted.

6. A nonreciprocal circuit device according to claim 5, wherein said inductor is formed of an electrode pattern disposed on a surface of said terminal board.

7. A nonreciprocal circuit device according to claim 6, wherein a capacitor electrode which is electrically connected to a connection point between said inductor and the corresponding said terminal is formed on said terminal board, and a capacitor is formed by said capacitor electrode between said connection point and ground.

8. A nonreciprocal circuit device according to claim 7, wherein said low-pass filter is further formed by said capacitor formed between said connection point and ground.

9. A nonreciprocal circuit device according to claim 5, wherein said inductor is formed of an electrode pattern disposed inside said spacer member.

10. A nonreciprocal circuit device according to claim 5, wherein said terminal board further comprises:

a first layer having a connection electrode and a first ground electrode provided on an upper surface thereof and said inductor provided on a lower surface thereof;

a second layer; and a third layer having said terminal corresponding to said inductor and a second ground electrode provided on a lower surface thereof, wherein one end of said inductor is connected to said connection electrode, the other end of said inductor is connected to said terminal and said first ground electrode is connected to said second ground electrode, and said second layer is disposed between said first layer and said third layer such that said inductor is disposed inside said terminal board.

11. A nonreciprocal circuit device according to claim 10, wherein:

said first layer further comprises a capacitor electrode which is provided on said lower surface thereof and is connected to a connection point between said inductor and said terminal; and said third layer further comprises a third ground electrode provided on a upper surface thereof, wherein capacitances are formed between said capacitor electrode and said first ground electrode of said first layer and between said capacitor electrode and said third ground electrode of said third layer, and said capacitances are connected in parallel to said stray capacitance.

* * * * *